US007069922B1

(12) United States Patent
Orr

(10) Patent No.: US 7,069,922 B1
(45) Date of Patent: Jul. 4, 2006

(54) PAINTBALL MARKER INTERNAL RESET SYSTEM

(75) Inventor: Jeffrey G. Orr, Corona, CA (US)

(73) Assignee: WGP, LLC, Beutonville, AR (US)

( * ) Notice: Subject to any disclaimer, the term of this patent is extended or adjusted under 35 U.S.C. 154(b) by 0 days.

(21) Appl. No.: 11/012,505

(22) Filed: Dec. 15, 2004

(51) Int. Cl.
*F41B 11/00* (2006.01)

(52) U.S. Cl. ..... 124/73

(58) Field of Classification Search ..... 124/56–77
See application file for complete search history.

(56) References Cited

U.S. PATENT DOCUMENTS

| | | | | |
|---|---|---|---|---|
| 43,573 | A | 7/1864 | Crane | 15/104.18 |
| 57,846 | A | 9/1866 | Bausman | 15/104.16 |
| 143,139 | A | 9/1873 | Gould | 15/104.16 |
| 645,932 | A | 3/1900 | Ferrant | 89/125 |
| 1,167,178 | A | 1/1916 | Hill | 124/56 |
| 1,343,127 | A | 6/1920 | Hallinan | 124/54 |
| 1,743,576 | A | 1/1930 | Smith | 124/72 |
| 2,453,683 | A | 11/1948 | Caldow | 42/70 |
| 2,484,267 | A | 10/1949 | Bower | 15/242 |
| 2,550,887 | A | 5/1951 | Tratsch | 124/1 |
| 2,563,720 | A | 8/1951 | Guisasola | 42/70 |
| 2,568,432 | A | 9/1951 | Cook | 124/13 |
| 2,834,332 | A | 5/1958 | Guthrie | 124/13 |
| 2,845,055 | A | 7/1958 | Collins et al. | 124/11 |
| 3,089,476 | A | 5/1963 | Wolverton | 124/11 |
| 3,240,200 | A | 3/1966 | Jones | 124/11 |
| 3,273,553 | A | 9/1966 | Doyle | 124/3 |
| 3,374,708 | A | 3/1968 | Wall et al. | 89/1 |
| 3,494,344 | A | 2/1970 | Vadas et al. | 124/11 |
| 3,548,708 | A | 12/1970 | Hubigh | 89/1.818 |
| 3,572,310 | A | 3/1971 | Chiba | 124/11 |
| 3,695,246 | A | 10/1972 | Filippi et al. | 124/11 |
| 3,818,887 | A | 6/1974 | Akiyama et al. | 124/15 |
| 3,899,845 | A | 8/1975 | Wild et al. | 42/69 |
| D237,678 | S | 11/1975 | Spencer | D7/179 |
| 3,923,033 | A | 12/1975 | Laporte et al. | 124/8 |
| 4,066,000 | A | 1/1978 | Rostocil | 89/198 |
| 4,133,128 | A | 1/1979 | Brush | 42/70 R |
| 4,207,799 | A | 6/1980 | Tocco | 89/196 |
| 4,282,795 | A | 8/1981 | Beretta | 89/148 |

(Continued)

FOREIGN PATENT DOCUMENTS

DE 19518884 6/1994

(Continued)

*Primary Examiner*—Michael Carone
*Assistant Examiner*—Gabriel Klein
(74) *Attorney, Agent, or Firm*—Keisling Pieper & Scott PLC; David B. Pieper; Trent C. Keisling

(57) ABSTRACT

An internal reset system for paint ball markers. A hammer body as modified rearwardly to include an axial opening to receivably retain the forward head of a reset rod. The forward portion of the reset rod is thus free to reciprocate within the axial opening, but restrained, during the reset phase, when the head of the reset rod internally encounters a flange at the rear of the axial opening. In this phase the reset rod carries the hammer to the reset position, compressing a spring, where it is retained by the trigger sear ready for the next firing. The rear end of the reset rod is affixed to a back block that mechanically connects the modified hammer assembly and the marker bolt. In one embodiment the hammer is modified by a hammer sleeve, attached rearwardly to the hammer body and having an axial opening for the head of the reset rod.

11 Claims, 7 Drawing Sheets

U.S. PATENT DOCUMENTS 4,347,679 A 9/1982 Grunig et al. ..... 42/84
4,362,145 A 12/1982 Stelcher ..... 124/32
4,516,273 A 5/1985 Gregory et al. ..... 2/2
4,589,327 A 5/1986 Smith ..... 89/148
4,602,608 A 7/1986 Lacam et al. ..... 124/74
4,679,487 A 7/1987 Houseman ..... 89/140
4,694,815 A 9/1987 Hung ..... 124/27
4,770,153 A 9/1988 Edelman ..... 124/72
4,779,245 A 10/1988 Chelminski ..... 367/144
4,785,930 A 11/1988 Fischer et al. ..... 206/3
4,819,609 A 4/1989 Tippmann ..... 124/72
4,899,717 A 2/1990 Rutten et al. ..... 124/67
4,936,282 A 6/1990 Dobbins et al. ..... 124/74
4,940,138 A 7/1990 Hornstein ..... 206/218
D321,325 S 11/1991 Petrus ..... D9/435
5,063,905 A 11/1991 Farrell ..... 124/72
5,068,990 A 12/1991 Marzocco ..... 42/70.04
5,078,118 A 1/1992 Perrone ..... 124/74
5,149,898 A 9/1992 Chesnut et al. ..... 42/69.01
5,228,427 A 7/1993 Gardner, Jr. ..... 124/71
5,251,533 A 10/1993 Layton ..... 89/142
5,261,384 A 11/1993 Hu ..... 124/66
5,280,778 A 1/1994 Kotsiopoulos ..... 124/73
5,282,454 A 2/1994 Bell et al. ..... 124/49
5,293,708 A 3/1994 Strayer et al. ..... 42/75.03
5,349,939 A * 9/1994 Perrone ..... 124/76
5,363,834 A 11/1994 Stuchlik ..... 124/76
5,370,105 A 12/1994 Firman ..... 124/56
5,413,083 A 5/1995 Jones ..... 124/32
5,462,042 A 10/1995 Grenwell ..... 124/76
D366,514 S 1/1996 Hochstrate et al. ..... D22/108
5,503,137 A 4/1996 Fusco ..... 124/72
5,596,162 A 1/1997 Burns ..... 89/128
5,613,483 A 3/1997 Lukas et al. ..... 124/73
5,634,456 A 6/1997 Perrone ..... 124/76
5,635,663 A 6/1997 Krieger et al. ..... 89/142
5,718,074 A 2/1998 Keeney ..... 42/69.03
D393,115 S 3/1998 Bell et al. ..... D32/35
5,727,538 A 3/1998 Ellis ..... 124/77
5,736,720 A 4/1998 Bell et al. ..... 235/1
5,755,213 A 5/1998 Gardner, Jr. et al. ..... 124/73
5,760,328 A 6/1998 Robbins ..... 89/129.02
5,799,434 A 9/1998 Krieger et al. ..... 42/69.03
5,816,232 A 10/1998 Bell ..... 124/51.1
5,868,637 A 2/1999 Poxon ..... 473/469
5,878,736 A 3/1999 Lotuaco, III ..... 124/71
5,881,707 A 3/1999 Gardner, Jr. ..... 124/77
5,890,479 A * 4/1999 Morin ..... 124/31
5,913,303 A 6/1999 Kotsiopoulos ..... 124/31
5,957,119 A 9/1999 Perry et al. ..... 124/73
5,967,133 A 10/1999 Gardner, Jr. ..... 124/77
6,003,504 A 12/1999 Rice et al. ..... 124/73
6,015,058 A 1/2000 Parks ..... 220/229
6,035,843 A 3/2000 Smith et al. ..... 124/77
6,048,280 A 4/2000 Palmer et al. ..... 473/416
6,055,975 A 5/2000 Gallagher et al. ..... 124/50
6,065,460 A 5/2000 Lotuaco, III ..... 124/72
6,138,656 A 10/2000 Rice et al. ..... 124/73
6,142,137 A 11/2000 MacLaughlin ..... 124/72
6,212,812 B1 4/2001 Aigner ..... 42/70.06
6,223,460 B1 5/2001 Schmitter et al. ..... 42/70.06
6,256,917 B1 7/2001 Findlay ..... 42/70.06
6,260,821 B1 7/2001 Perry et al. ..... 251/314
6,311,682 B1 11/2001 Rice et al. ..... 124/71
6,349,711 B1 2/2002 Perry et al. ..... 124/73
D454,685 S 3/2002 Parks et al. ..... D3/254
6,382,200 B1 5/2002 Levkov ..... 124/73
D458,333 S 6/2002 Power ..... D22/108
D460,502 S 7/2002 Traum et al. ..... D21/573
6,439,217 B1 8/2002 Shih ..... 124/77
6,474,325 B1 11/2002 Rice et al. ..... 124/71
6,474,326 B1 11/2002 Smith et al. ..... 124/77
6,494,194 B1 12/2002 Shipachev et al. ..... 124/73
6,494,195 B1 12/2002 Perry et al. ..... 124/84
6,532,949 B1 3/2003 McKendrick ..... 124/77
D473,910 S 4/2003 Rice et al. ..... D22/108
6,550,468 B1 4/2003 Tippmann, Jr. ..... 124/71
6,553,983 B1 4/2003 Li ..... 124/73
6,578,566 B1 6/2003 Hernandez ..... 124/73
6,590,386 B1 7/2003 Williams ..... 324/178
6,615,814 B1 9/2003 Rice et al. ..... 124/71
6,626,165 B1 9/2003 Bhogal ..... 124/77
6,629,379 B1 10/2003 Doiron ..... 42/70.11
6,637,420 B1 10/2003 Moritz ..... 124/73
6,637,421 B1 10/2003 Smith et al. ..... 124/77
6,644,295 B1 11/2003 Jones ..... 124/77
6,644,296 B1 11/2003 Gardner, Jr. ..... 124/77
6,658,982 B1 12/2003 Cherry ..... 89/1.42
D484,926 S 1/2004 Rice et al. ..... D21/573
6,694,963 B1 2/2004 Taylor ..... 124/32
6,705,036 B1 3/2004 Orr ..... 42/69.01
6,725,852 B1 4/2004 Yokota et al. ..... 124/49
6,729,497 B1 5/2004 Rice et al. ..... 220/835
6,739,322 B1 5/2004 Rice et al. ..... 124/49
6,748,938 B1 6/2004 Rice et al. ..... 124/77
6,763,822 B1 7/2004 Styles ..... 124/77
D496,556 S 9/2004 Skrocki et al. ..... D7/391
6,802,305 B1 10/2004 Hatcher ..... 124/31
6,802,306 B1 10/2004 Rice ..... 124/74
2003/0121927 A1 7/2003 Rice et al. ..... 220/833
2003/0131514 A1 7/2003 Rice et al. ..... 42/69.01
2003/0131834 A1 7/2003 Rice et al. ..... 124/32
2003/0154968 A1 8/2003 Rice et al. ..... 124/71
2003/0178018 A1 9/2003 Cherry ..... 124/76
2003/0221684 A1 12/2003 Rice ..... 124/71
2004/0011344 A1 1/2004 Rice et al. ..... 124/73
2004/0031836 A1 2/2004 Garcia ..... 224/665
2004/0074489 A1 4/2004 Neumaster et al. ..... 124/79
2004/0084040 A1 5/2004 Jones ..... 124/77

FOREIGN PATENT DOCUMENTS

FR 2801567 10/1999
GB 2252302 8/1992
GB 2370027 6/2002
GB 2391292 2/2004

* cited by examiner

PAINTBALL MARKER INTERNAL RESET SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

This invention relates to pneumatically operated projectile launching devices and more particularly to an internal reset system for such automatic or semiautomatic paint ball markers such as those sold under the trademark AUTOCOCKER® which is configured to significantly improve the efficiency of the reset hammer assembly.

2. Description of the Known Art

The equipment used to fire paint balls are commonly referred to as paintball "markers". Markers launch the paint balls by releasing a burst of compressed gas (typically CO2, N2, or air) into a barrel behind the paintball projectile. Projectile launchers operated by means of a supply of pressurized gas have been known for quite some time and have been used to fire a variety of projectiles including pellets and small balls. In more recent years, gas operated markers have been developed and designed specifically to fire paint balls. The paint balls typically may comprise a mixture of a liquid including ethylene glycol with the liquid being encased in a fragile gelatin casing designed to break apart upon striking a target. The liquid will then mark the target that has been hit. These types of markers have a variety of different uses. Earlier uses involved tree marking in forestry projects and animal marking in conservation or farming projects. For example, the markers were originally used to segregate livestock within a herd, assist in the counting of wild animals or for training of military or law enforcement personnel through simulation exercises. Likewise, these markers may be used by military and law enforcement personnel for crowd control.

Another very popular use for such markers is recreation in the game of "paintball". In particular, paintball markers are used for "mock war games" in which participants dressed in protective gear attempt to hit other combatants with paint balls thereby marking them and eliminating them from the game.

As will be appreciated by those skilled in the art, a variety of different types of paint ball markers exist in the field using a variety of mechanisms for accomplishing their purpose of projecting paint balls. Patents disclosing information relevant to paintball markers include U.S. Pat. No. 3,788,298, issued to Hale on Jan. 29, 1974; U.S. Pat. No. 4,147,152, issued to Fisher et al. on Apr. 3, 1979; U.S. Pat. No. 4,531,503, issued to Shepard on Jul. 30, 1985; U.S. Pat. No. 5,462,042, issued to Greenwell on Oct. 31, 1995; U.S. Pat. No. 5,505,188, issued to Williams on Apr. 9, 1996; U.S. Pat. No. 5,515,838, issued to Anderson on May 14, 1996; U.S. Pat. No. 6,439,217, issued to Shih on Aug. 27, 2002; U.S. Pat. No. 6,553,983, issued to Li on Apr. 29, 2003; U.S. Pat. No. 6,561,176, issued to Fujimoto et al. on May 13, 2003; U.S. Pat. No. 6,578,566 issued to Hernandez on Jun. 17, 2003; U.S. Pat. No. 6,658,982 issued to Cherry on Dec. 9, 2003; U.S. Pat. No. 6,637,420, issued to Moritz on Oct. 28, 2003; and U.S. Pat. No. 6,715,480 issued to Dziob on Apr. 6, 2004. The entirety of each of these patents is hereby expressly incorporated by reference.

U.S. Pat. Nos. 3,788,298; 4,147,152; 4,531,503; and 5,505,188 are typical of paint ball markers wherein the hammer and/or bolt are in a single barrel.

U.S. Pat. Nos. 5,462,042; 5,515,838; 6,553,983; and 6,561,176 are typical of paintball markers wherein the marker body comprises two parallel tubular bores. The upper bore contains the bolt, while the lower bore contains the hammer. The bolt and hammer components are connected together, allowing their moving parts to move in concert. The bolt and hammer assembly is held in the reset position via a trigger sear, which catches the hammer portion of the assembly. In this position, the breach is open and a paint ball is able to drop into position in front of the bolt. When the trigger is pulled, the sear releases the hammer and a spring drives the hammer and bolt forward. As the bolt moves forward the hammer simultaneously moves forward to strike a poppet valve as the bolt closes on the chamber. The poppet valve releases a burst of high pressure gas into and through the bolt, expelling the paint ball from the barrel. A bleed-off of the burst of high pressure gas then propels the hammer and bolt backwards. The hammer is then caught by the trigger sear, and the marker is again in a reset configuration and ready to be fired again.

Another form of marker using two parallel tubular bores is shown in U.S. Pat. No. 6,637,420 wherein the hammer and bolt operate independently of each other. One attribute which is extremely important to users of paint ball markers which are intended for such recreational war games, as well as those used for other purposes, is the rate at which the marker may be fired. Obviously, markers which are capable of increased firing rates offer the user a significant competitive advantage over his/her fellow combatants. One significant factor which influences the firing rate of any weapon is the type of hammer and bolt assembly. Paint ball markers typically may employ manual, semi-automatic and fully automatic firing arrangements. As is well known, manual firing arrangement requires appropriate manipulation of the trigger before successive projectiles are fired. In contrast, a semi-automatic firing arrangement enables a projectile to fired and reset each time the trigger is depressed, while an automatic firing arrangement will fire multiple projectiles each time the trigger is pulled and held.

In paint ball markers that are semi-automatic, a new projectile is automatically loaded into firing position immediately after launch of a preceding paint ball. Such paint ball markers typically utilize a reciprocating bolt. The bolt serves two primary functions. First, the bolt cycles between a loading position in which the outlet of the projectile magazine is uncovered permitting a paint ball to drop into a breech, or bolt chamber, of the paint ball marker, and then to a launch position in which the bolt moves toward the muzzle or barrel of the marker covering the magazine outlet. Second, when in the "launch" position, the bolt re-directs a charge of compressed gas released from a chamber in the marker to propel the paint ball out the muzzle end of the barrel toward a target. The expanding gas of the propellant charge transfers energy to the projectile, expelling it from the barrel of the marker. It is the efficiency of this energy transfer that ultimately determines what quantity, i.e., pressure of propellant charge required to propel a paint ball at a given velocity.

For an automatic or semiautomatic marker using this independent bolt to hammer configuration, a three-way valve is used to direct compressed gas to reset the marker to be ready for the next firing. As the trigger is further pulled past release of a sear, a timing rod acts through a mechanical assembly to direct gas through the three-way valve to a ram that pushes the hammer and bolt rearward to the reset position. During the rearward movement, the hammer compresses a spring until the hammer is retained by engagement of a trigger sear in preparation for a next firing. The timing rod is adjustably connected to a coupler at the three-way valve to achieve correct timing. The effective length of the timing rod is precise to assure that gas is released at only the appropriate time to reset the marker. If the timing rod is set improperly, the reset occurs at the wrong time relative to the firing sequence, or not at all, and the marker fails to operate.

Variances in friction between the hammer and its chamber wall, whether caused by wear, dirt or the like, affect the magnitude and duration of hammer pressurization required to fully reset it. If friction is low, the hammer moves quickly and smoothly and the relevant volume of gas in the hammer chamber expands rapidly. Such rapid expansion may detract from the pressure used to discharge the projectile and projectile velocity is reduced. On the other hand, if friction is higher, the hammer may move more slowly, the volume of gas in the hammer chamber expands slowly and the primary valve is retained open for a longer period of time. As a consequence, substantially full input pressure continues to be applied to the projectile, notwithstanding that it is well down the barrel. This decreases the consistency and predictability of projectile velocity and thus effects the "dynamics" of projectile discharge such that projectile velocity may not be the same from shot to shot. As a result, the marker may require a different aiming point for each shot—this is a very annoying problem for the user.

To understand this invention, operation of paintball markers in general must be understood. As noted in the background section, FIG. 1 is presented to depict a paint ball maker 100 of the prior art. This prior art marker needs to be understood to aid in the description of the improved internal reset assembly 200 as set forth in this invention.

As shown in FIG. 1, the basic marker 100 comprises a marker body 110 with an attached barrel 112, pistol grip 114, and reset ram assembly 116. The reset ram assembly 116 includes a three way valve 117 which is controlled by the trigger 153. A compressed gas supply, not shown, is connected to receiver 118 and regulator 119. The receiver 119 directs compressed gas through first line 115 to the reset ram assembly 116 from the three way valve 117 attached to the marker body 110. A second line 113 is connected from the front of the valve 117 to the rear of the reset ram assembly 116. With these connections, the three way valve 117 controls the position of the valve ram 152 within the reset ram assembly 116. The reset ram assembly 116 is connected by the valve ram 152 to the back block 142. The back block 142 is connected to the bolt 140 and has a limited sliding connection with the hammer reset rod 146. In this manner, the trigger controls the rest ram assembly 116 and the reset ram assembly 116 directly controls the position of the bolt 140 and influences the position of the hammer 128 through the valve ram 152.

The bolt 140 controls the loading of the paintball projectile 122 into the firing chamber 124. A paint ball projectile magazine 120 is mounted to the marker body 110 to supply paint ball projectiles 122. When the bolt 140 is in the rearward bolt loading position the paintball falls into the bolt chamber 124. The bolt 140 is then moved into the firing position as shown in FIG. 1.

The bolt 140 includes forward passage 141 which is sealed from passage 132 in the rearward or reset position. The bolt 140 may include appropriate o-ring seals, not numbered, to effectively create a piston effect to the bolt 140 as it reciprocates in the bolt chamber 124. When the bolt 140 is then moved into the firing position, the bottom opening of the forward passage 141 will be in alignment with passage 132 thereby directing compressed gas into chamber 124 to expel the paint ball 122. Now that bolt 140 movement is understood for chambering a paintball projectile 122, the release of the pressurized gas and reset of the marker will be understood through the motion of the hammer 128.

Parallel to the bolt chamber 124 is a hammer chamber 126 in which the prior art version of a hammer 128 is shown in the reset position 129 from which the hammer 128 reciprocates. A propellant storage chamber 130 receives compressed gas from the receiver 118 and regulator 119 via conduits, not shown, to supply compressed gas for propelling the paintball 122. The compressed gas in the storage chamber 130 is held back by the poppet valve 136 which is opened by movement of the exhaust valve pin 134. Once the valve 136 is opened, compressed gas travels through firing gas supply passage 132 and the bolt passage 141 into the bolt chamber 124 for discharging the paintball projectile 122. The firing valve 136 is normally held closed by firing valve spring 138.

Just as the back block 142 affects the position of the bolt 140 in the bolt chamber 124, the back block influences the position of the hammer 128 via the sliding connection of the reset rod 146 with the back block 142. In this prior art version 100 the reset rod 146 is fixably attached to the hammer 128 and has a sliding connection with the back block 142. When the hammer 128 is released, the pressure of spring 145 moves the hammer 128 forward and the reset rod 146 slides in the back block 142. An artificial limit may be imposed on the forward movement of the hammer 128 by limiting the movement with the flange 144 of the reset rod 146 striking the back block 142.

During the reset phase, the back block 142 normally returns the bolt 140 and contacts the flange 144 on the reset rod 146 to return the attached hammer 128 to the reset position shown in FIG. 1 by compressing spring 145 to the position as shown. The back block 142 and bolt 140 will then return to the firing position. This leaves the reset rod 146 extended. Because the reset rod 146 is extended, it is subject to being bent or collecting dust or dirt. All of these may affect marker performance and operation. It is this extended position required by the exterior and rearward movement of the reset rod 146 that is objectionable in the use of the markers 100 of the prior art and to which this invention of internal reset assembly 200 is an improvement.

Thus, it may be seen that these prior art patents are very limited in their teaching and utilization, and an improved paintball marker is needed to overcome these limitations.

SUMMARY OF THE INVENTION

The present invention is directed to improved reset system for a paintball marker. In accordance with one exemplary embodiment of the present invention, an internal sliding hammer head is provided.

It is a general object of the present invention to provide an improved bolt and hammer assembly for paint ball markers that overcomes the objections to the prior art devices.

It is a further object of the invention to provide a paint ball marker having an internal reset rod and hammer assembly that eliminates the exterior slidable connection of the reset rod and back block.

This invention is directed to improvements in the hammer assembly for those types of markers having substantially parallel bolt and hammer chambers. The bolt and hammer assembly are connected via a back block for substantially simultaneous movement in their respective chambers during the reset operation. The new hammer assembly includes a hammer body as modified rearwardly to include an axial opening to receivably retain the head of an internal reset rod. The forward portion of the internal reset rod is thus free to reciprocate within the axial opening, but restrained, during the reset phase, when the head of the internal reset rod internally encounters a flange at the rear of the axial opening. In this phase the internal reset rod carries the hammer to the reset position, against a compression spring, where it is retained by the trigger sear ready for the next firing. The rear end of the internal reset rod is affixed to the back block. In one embodiment the hammer is modified by a hammer sleeve, having an axial opening for the head of the internal reset rod. Such a hammer sleeve is attached to the rearward portion of the hammer body.

These and other features and advantages of the invention will be more readily apparent upon reading the following description of a preferred exemplified embodiment of the invention, the construction and operation and claims, reference being had to the to the accompanying drawings forming a part hereof.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 14 is a back view of the hammer head used as apart of the hammer assembly FIG. 15 is a sectional side view of the hammer head used as apart of the hammer assembly looking down the set screw aperture.

FIG. 16 is a front view of the hammer head used as apart of the hammer assembly.

FIG. 17 is a rotated sectional top view of the hammer head looking down the trigger thread aperture.

FIG. 18 is a side view of the improved internal reset system of FIG. 7.

DETAILED DESCRIPTION OF THE INVENTION

Figure 1:
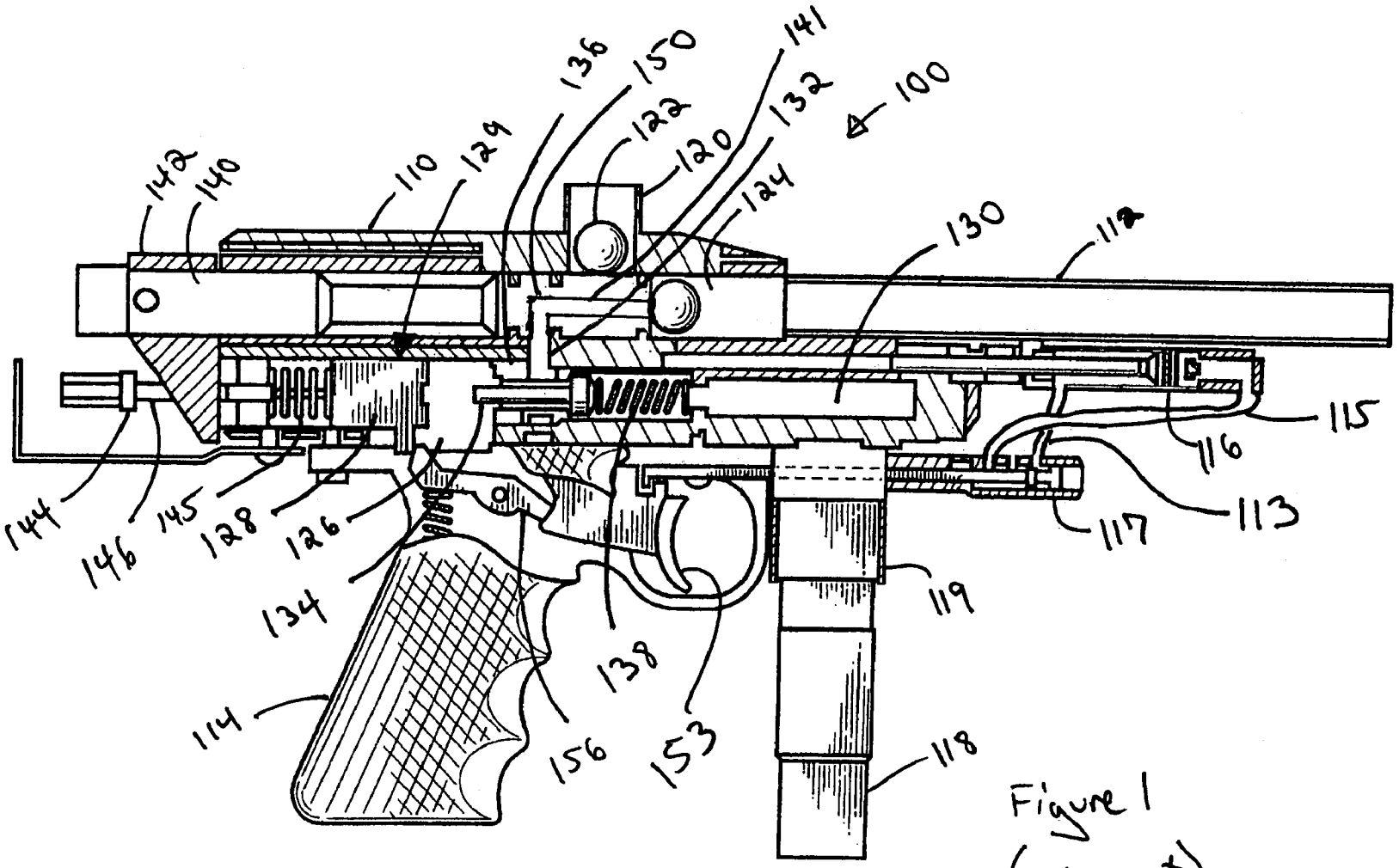
Figure 1 (prior art)
FIG. 1 is a side cross sectional view of a prior art paint ball marker in a reset ready-to-fire position.
Figure 2:
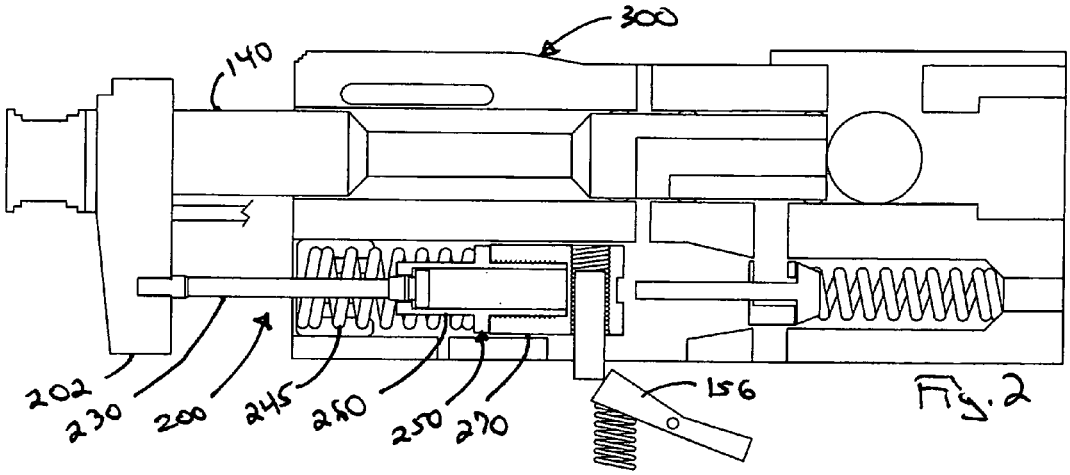
FIG. 2 is a partial sectional view of a marker using the improved internal reset system of this invention with the parts shown in the fully reset position.
Figure 3:
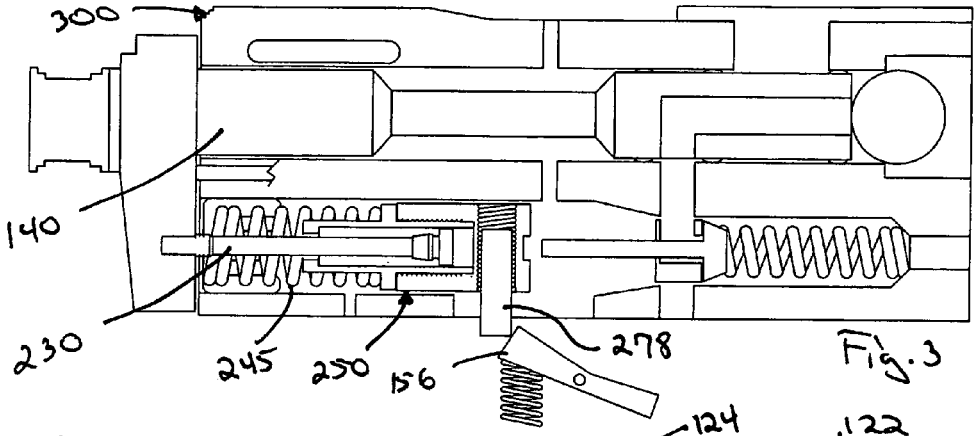
FIG. 3 is a partial sectional view of a marker using the improved internal reset system of this invention with the parts shown in the ready-to-fire position.
Figure 4:
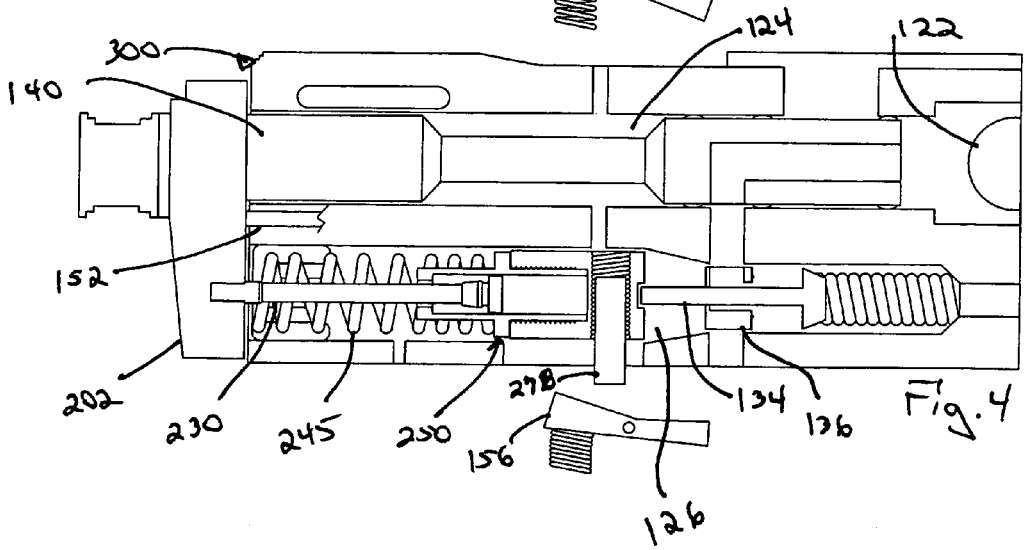
FIG. 4 is a partial sectional view of a marker using the improved internal reset system of this invention with the parts shown in the fire position.
Figure 5:
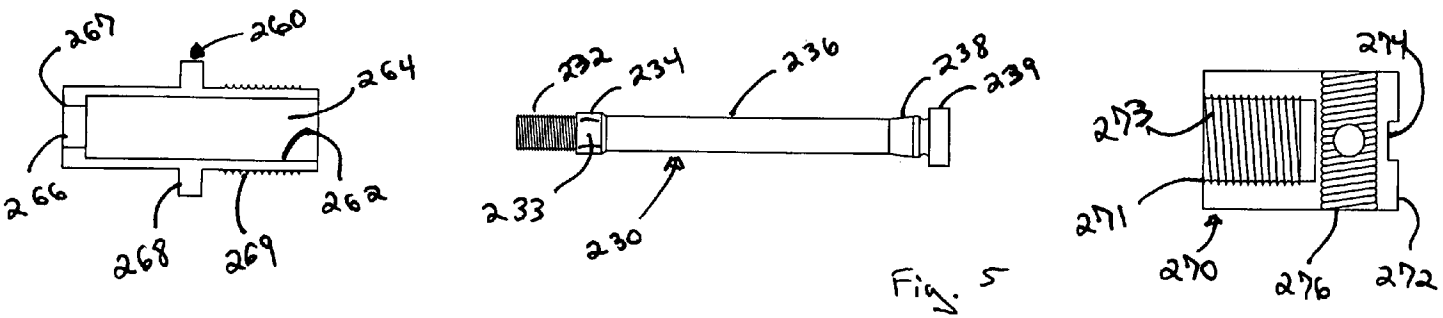
FIG. 5 is an exploded sectional view of the improved internal reset system of this invention.
Figure 6:
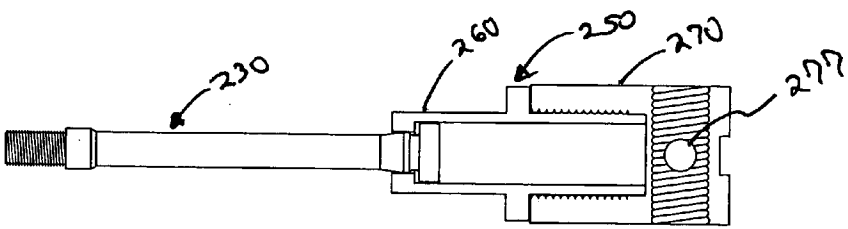
FIG. 6 is a sectional view of the improved internal reset system of this invention shown in the firing position.
Figure 7:
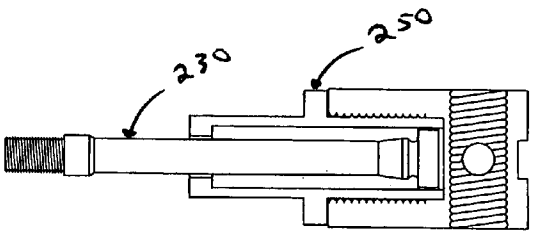
FIG. 7 is a sectional view of the improved internal reset system of this invention shown in the reset position.
Figure 10:
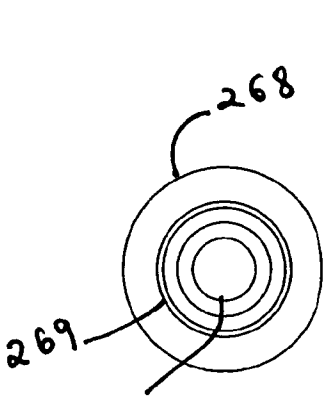
FIG. 10 is a front view of the hammer sleeve used as apart of the hammer assembly.
Figure 9:
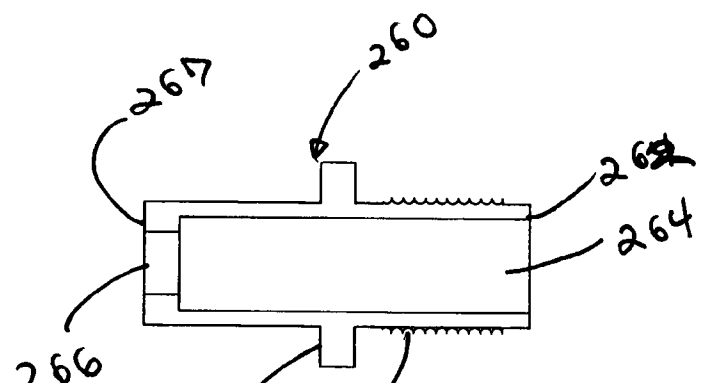
FIG. 9 is a sectional side view of the hammer sleeve used as apart of the hammer assembly.
Figure 8:
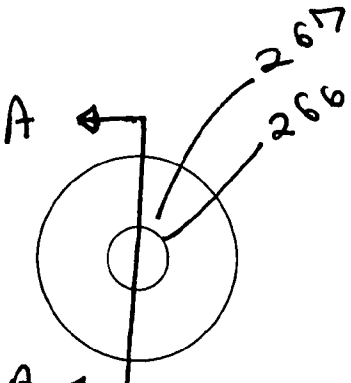
FIG. 8 is a back view of the hammer sleeve used as apart of the hammer assembly
Figures 11, 12, 13:
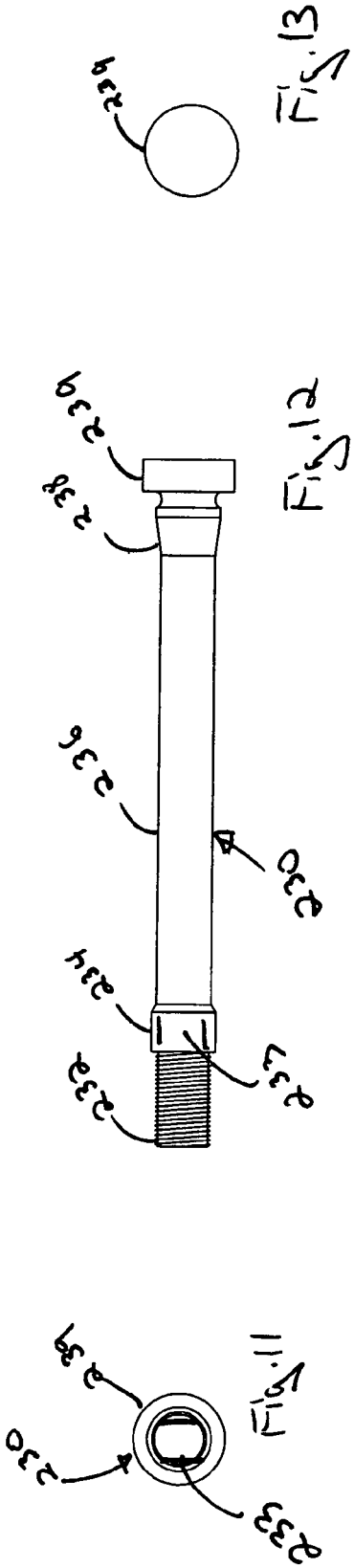
FIG. 11 is a back view of the reset rod used as apart of the hammer assembly
FIG. 12 is a sectional side view of the reset rod used as apart of the hammer assembly.
FIG. 13 is a front view of the reset rod used as apart of the hammer assembly.
Figure 6:
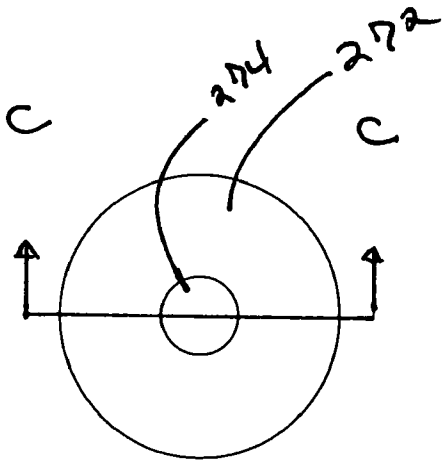
Figure 3:
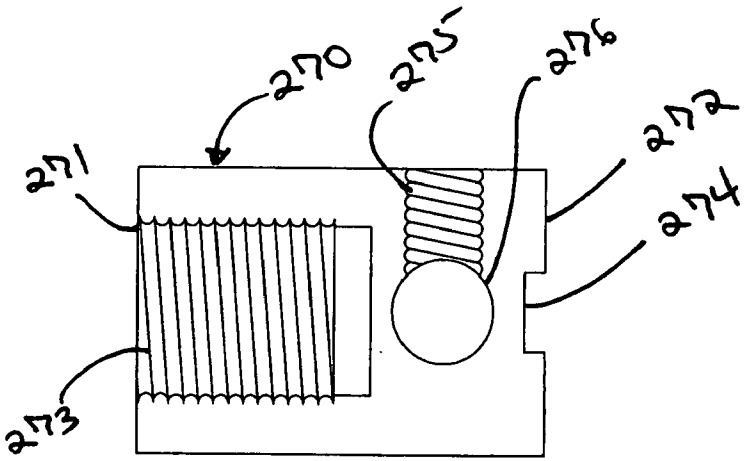
Figure 5:
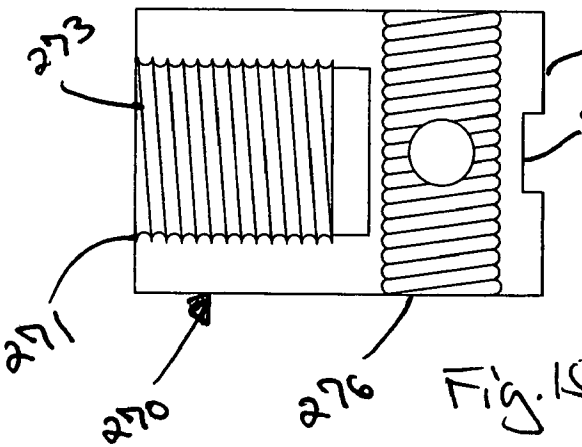
Figure 4:
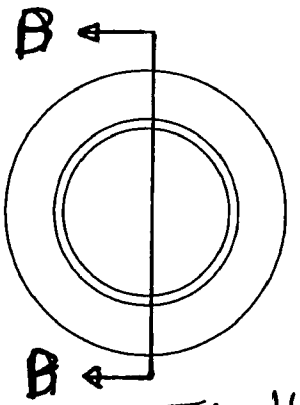
Figure 8:
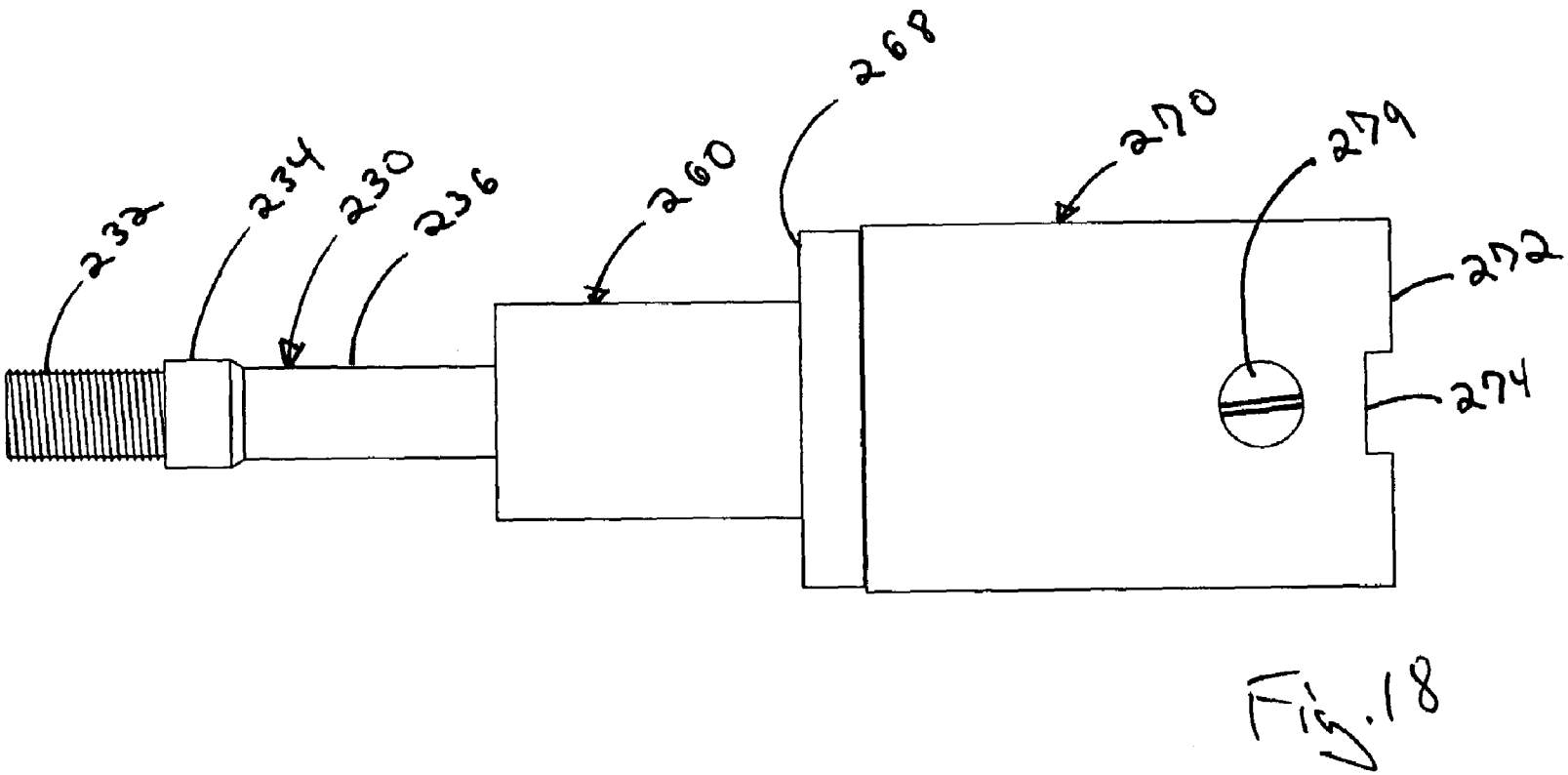

As shown in FIGS. 2 through 18 of the drawings, one exemplary embodiment of the present invention is generally shown as an internal reset system 200 for an internal sliding hammer paintball marker 300. The internal reset system 200 uses a fixed connection back block 202, an internal reset rod 230, and an internal sliding hammer 250 made from a hammer sleeve 260 and a hammer body 270. FIG. 2 shows the internal reset system in the reset position with the internal reset rod 230 pulling the internal sliding hammer 250 back to catch the sear 156 to ready the internal sliding hammer paintball marker 300 for the next firing. FIG. 3 depicts the marker 300 in the ready to fire position with the bolt 140 and the internal sliding reset rod 230 moved forward inside the internal sliding hammer paintball marker 300. Note that the internal sliding hammer 250 has remained in the retracted position due to the sear 156. FIG. 4 depicts the release of the internal sliding hammer 250 by the sear 156 and the internal sliding hammer 250 contact with the rod 134 of the valve 136 to release the compressed gas for firing the paintball projectile 122. The internal sliding hammer paintball marker 300 is then reset by the backwards movement of the fixed connection back block 202.

The fixed connection back block 202 is shown at the rear of the marker 300 and its movement is controlled by the valve ram 152 as is well known in the prior art version of the sliding back block 142. However, the present invention has a fixed connection between the fixed connection back block 202 and the internal sliding reset rod 230. The fixed connection back block 202 is also attached to the bolt 140 which reciprocates in the bolt chamber 124 so that this motion is now in unison with the internal sliding reset rod 230 in the hammer chamber 126.

Details of the internal sliding reset rod 230 are shown in FIGS. 5 through 7 and 11 through 13. The internal sliding reset rod 230 has a threaded end 232, a stop 234, a sliding shaft area 236, a centering flange 238, and a head 239 manufactured from a titanium alloy having both high strength and light weight. Flats 233 are provided on the stop 234 for a wrench to tighten the connection between the sliding reset rod 230 and the fixed connection back block 202. A key feature of the internal sliding reset rod 230 is that it is fixed in attachment to the fixed connection back block 202. While the preferred embodiment replaces the prior art back block 142 to make the threaded connection to the back block 202, it is envisioned that other fastening means are within the scope of the invention and an internal sliding reset rod could be fixably secured to the prior art types of back blocks 142 with almost any type of connection providing a secure connection. In fact, a long internal sliding reset rod 230 could be made with extended threads so that a fixed connection using the prior art's sliding aperture could be made.

The reset rod 230 and the reset rod head 239 reciprocate internally of the internal sliding hammer 250 although it is within the scope of this invention that a single hammer body can be modified with an axial opening and rearward flange means to reciprocably receive and retain the forward reset rod head 239 without a separate hammer sleeve. The internal sliding hammer 250 is made from a hammer sleeve 260 and a hammer body 270 defining an internal cavity 252.

The hammer sleeve 260 is shown in detail in FIGS. 5 through 7 and 8 through 10. The sleeve 260 has a central cylinder 262 defining a central bore 264, an axial end aperture 266 in a head capturing flange 267, a spring flange 268 and sleeve threads 269. The sleeve 260 and central cylinder 262 provide the control of the movement of the head 239 of the internal reset rod 230. The axial end aperture 266 reciprocably receives the modified internal sliding reset rod 230, yet retains and restrains the forward reset rod head 239 within the central bore 264. During the reset phase of operation of the marker 300, as the reset rod head 239 moves rearward it meets the head flange 267 and thereby carries the modified hammer assembly backwards. The spring flange 268 uses this backwards movement to compress the spring 245 until reset when the sear 156 latches. In this manner the spring flange 268 is used to secure the end of the compression spring 245 which acts to bias the hammer body 270 forward.

The working details of the hammer body 270 are shown in FIGS. 5 through 7 and 14 through 17. The hammer body 270 reciprocates in the hammer chamber 126 and includes a front face 272 with a recess 274 that is adapted to strike an exhaust valve pin 134 of a gas valve 136. Transverse threaded opening 276 receives an adjustable threaded lug 278 locked in place by set screw 279 set in the set screw aperture 277 with set screw threads 275. The set screw 279 holds the hammer assembly 250 in the reset position by co-action with trigger sear 156. Timing, i.e., the time between firing of the marker 300 and reset, can be adjusted by raising or lowering of the lug 278 relative to the sear 156. A threaded female opening 271 at the rear of the hammer body 270 is adapted to receive the threaded male hammer sleeve 260 via threads 273.

In the assembly of the internal reset system 200, the internal reset rod 230 is preassembled into the axial opening 266 of the hammer sleeve 260. Then the hammer body 270 is threaded to the hammer sleeve 260 forming the unified and internal sliding hammer 250.

Reference numerals used throughout the detailed description and the drawings correspond to the following elements:

paint ball maker 100
marker body 110
barrel 112
second line 113
pistol grip 114
first line 115
reset ram assembly 116
three way valve 117
receiver 118
regulator 119
magazine 120
paintball projectile 122
firing chamber 124
hammer chamber 126
hammer 128
reset position 129
propellant storage chamber 130
firing gas supply passage 132
exhaust valve pin 134
poppet valve 136
firing valve spring 138
bolt 140
forward passage 141
back block 142
flange 144
spring 145
hammer reset rod 146
valve ram 152
trigger 153
sear 156
internal reset assembly 200
fixed connection back block 202
internal sliding reset rod 230
fixed connection back block 202
threaded end 232
flats 233
stop 234
sliding shaft area 236
centering flange 238
head 239
spring 245
internal sliding hammer 250
internal cavity 252
hammer sleeve 260
central cylinder 262
central bore 264
axial end aperture 266
head capturing flange 267
spring flange 268
sleeve threads 269
hammer body 270
threaded female opening 271
front face 272
threads 273
recess 274
set screw aperture threads 275
threaded opening 276
set screw aperture 277
adjustable threaded lug 278
set screw 279
internal sliding hammer paintball marker 300

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A paint ball projectile marker comprising:

a bolt chamber and barrel through which a projectile is received and expelled;

a bolt in said bolt chamber sealably reciprocable between a first rearward reset position to accept said projectile into said bolt chamber to a second forward firing position wherein said projectile is expelled forwardly from said barrel by pressurized gas;

a hammer chamber connected to and parallel to said bolt chamber;

means connecting said bolt and a hammer assembly for simultaneous movement;

said hammer assembly comprising:

a hammer body reciprocable in said hammer chamber from said reset position to said firing position, said hammer body including a sear lug;

a reset rod, a forward head of said reset rod being axially and reciprocably retained in an opening in said hammer body, a rearward end of said reset rod being affixed to said means connecting said bolt and hammer;

a hammer spring normally biasing said hammer body towards said firing position;

means to supply projectiles into said bolt chamber in said reset position;

a handle and trigger assembly, said trigger including a pivotal sear releasably connected to said sear lug to retain said hammer body in said reset position against said hammer spring bias;

means to supply pressurized gas ultimately to said bolt chamber via a control valve positioned forwardly of said hammer body, said control valve comprising a valve pin normally spring biased to close said valve, said valve pin extending rearwardly into said hammer chamber in said reset position, whereby said hammer body when released will strike said valve pin to open said valve and supply said pressurized gas to said bolt chamber to expel said paint ball projectile; and means timed to connect with said pressurized gas to force a connected assembly of said bolt, said means connecting said bolt and a hammer, said reset rod and said hammer body to said reset position.

2. The paint ball projectile marker of claim 1 wherein said hammer body includes a hammer sleeve rearwardly connected to said hammer body, said hammer sleeve having an axial opening to receive and slidably retain said forward head of said reset rod, said opening including rearward flange means to support said forward head of said reset rod in order to move said hammer body and hammer sleeve to said reset position.

3. The paint ball projectile marker of claim 2 wherein said rearward means to support said forward head is a transverse flange projection.

4. The paint ball projectile marker of claim 1 wherein said rearward end of said reset rod is threadably attached to said means connecting said bolt and hammer.

5. A paint ball projectile marker comprising:

a bolt chamber and barrel through which a projectile is received and expelled;

a bolt in said bolt chamber sealably reciprocable between a first reset position to accept said projectile into said bolt chamber, to a second firing position wherein said projectile is expelled forwardly from said barrel by pressurized gas;

a hammer chamber connected to and parallel to said bolt chamber;

a back block exteriorly and rearwardly connecting said bolt and a hammer assembly;

said hammer assembly comprising:

a hammer body internally reciprocable in said hammer chamber from said reset position to said firing position, said hammer body including a lug;

a reset rod, a forward end of said reset rod having an enlarged head that is axially retained in said hammer body, a rearward end of said reset rod being affixed to said back block;

a hammer spring normally biasing said hammer body towards said firing position;

means to supply projectiles into said bolt chamber in said reset position;

a handle and trigger assembly, said trigger including a pivotal sear releasably connectable to said lug to retain said hammer body in said reset position against said spring bias;

means to supply pressurized gas ultimately to said bolt chamber via a control valve positioned forwardly of said hammer body, said control valve comprising a valve pin normally spring biased to close said valve, said valve pin extending rearwardly into said hammer chamber in said reset position, whereby said hammer body can strike said valve pin to open said valve and supply said pressurized gas to said bolt chamber to expel said paint ball projectile; and means connectable with said pressurized gas, after said projectile is expelled, to force a connected assembly of said bolt, said back block, said reset rod and said hammer body to said reset position.

6. The paint ball projectile marker of claim 5 wherein said hammer body includes a hammer sleeve rearwardly connected to said hammer body, said hammer sleeve having an axial opening to receive and slidably retain said enlarged head of said reset rod, said opening including a flange means, at the rearward end of said sleeve, to connect with and transport said reset rod, said hammer body and hammer sleeve to said reset position.

7. The paint ball projectile marker of claim 6 wherein said hammer sleeve is threadably connected to said hammer body.

8. An internal reset system for paint ball projectile markers of the type having a first chamber for a bolt and a parallel second chamber for a hammer assembly, and means to connect said bolt and said hammer assembly for substantially simultaneous movement in their respective chambers from a rearward reset position to a forward firing position of said marker, the improvement in said hammer assembly comprising:

a hammer body, said hammer body including sear lug means to releasably retain said hammer body in said reset position, a reset rod, a forward head of said reset rod being axially and reciprocably retained in said hammer body, a rearward end of said reset rod being affixed to said means connecting said bolt and hammer assembly; and a hammer spring normally biasing said hammer assembly towards said firing position.

9. An internal reset system of claim 8 wherein said hammer body includes an axial opening to receive and slidably retain said forward head of said reset rod, said opening including rearward flange means to support said forward head of said reset rod in order to move said hammer body and hammer sleeve to said reset position.

10. An internal reset system of claim 8 wherein said hammer body includes a hammer sleeve rearwardly connected to said hammer body, said hammer sleeve having an axial opening to receive and slidably retain said forward head of said reset rod, said opening including rearward flange means to support said forward head of said reset rod whereby said hammer body and hammer sleeve are returned to said reset position.

11. An internal reset system of claim 10 wherein said hammer sleeve is threadably connected to said hammer body.

* * * * *